United States Patent [19]

Hujer et al.

[11] 4,094,726

[45] June 13, 1978

[54] APPARATUS FOR PROCESSING EXPOSED PHOTOGRAPHIC FILMS AND CASSETTES FOR SUCH FILMS

[75] Inventors: Friedrich Hujer, Grünwald; Helmut Zangenfeind, Puchheim, both of Germany

[73] Assignee: Agfa-Gevaert Aktiengesellschaft, Leverkusen, Germany

[21] Appl. No.: 729,700

[22] Filed: Oct. 5, 1976

[30] Foreign Application Priority Data

Oct. 9, 1975 Germany ..... 2545214

[51] Int. Cl.[2] ..... G03D 15/04

[52] U.S. Cl. ..... 156/502; 354/313

[58] Field of Search ..... 156/502, 504, 505, 506, 156/543, 552; 354/307, 312, 313

[56] References Cited

U.S. PATENT DOCUMENTS

| | | | |
|---|---|---|---|
| 3,779,837 | 12/1973 | Zahn et al. | 156/506 X |
| 3,854,812 | 12/1974 | Sorli | 354/307 X |
| 3,866,744 | 2/1975 | Klose | 221/172 X |
| 3,921,878 | 11/1975 | Zangenfeind | 226/91 |

*Primary Examiner*—David Klein

*Assistant Examiner*—William H. Thrower

*Attorney, Agent, or Firm*—Peter K. Kontler

[57] ABSTRACT

Apparatus for uniting exposed photographic roll films into a continuous web which is already for transport through a developing machine has a housing which is lightproof and has two inlets, one for admission of cassettes which contains exposed films and the other for reception of exposed films. Successive cassettes which are introduced through the first inlet are conveyed into the range of a film removing mechanism which automatically removes the films, without breaking the respective cassettes, and the removed films are transported to a splicing device. If the position of roll film in a cassette is such that the film cannot be expelled by the removing mechanism in the housing, the cassette is opened in a darkroom and the film which is removed from the opened cassette is introduced though the second inlet. Such film is transported to the splicing device, preferably along a path a portion of which coincides with a portion of the path for transport of films from the film removing mechanism to the splicing device. One of the inlets is closed when the other inlet is open, and vice versa.

20 Claims, 2 Drawing Figures

APPARATUS FOR PROCESSING EXPOSED PHOTOGRAPHIC FILMS AND CASSETTES FOR SUCH FILMS

BACKGROUND OF THE INVENTION

The present invention relates to apparatus for processing exposed photographic films and containers for exposed photographic films. More particularly, the invention relates to improvements in apparatus, known as presplicers, which are utilized in photographic processing laboratories to unite a large number of exposed customer films into a continuous web which is ready for transport through a developing machine.

Photographic roll films which are delivered or mailed to a processing laboratory for development and the making of prints are usually spliced together to form a long web often having a length in the range of several hundred meters. The web is coiled onto a reel and is thereupon advanced through a developing machine. As a rule, the developed web is thereupon advanced through a printing or copying machine which makes reproductions of some or all film frames. The prints are inserted into envelopes, together with the corresponding films (which can be subdivided into sections each consisting of several frames), and the envelopes are mailed to or picked up by the dealers or directly by the customers.

Exposed photographic roll films are shipped or delivered to a processing laboratory together with the corresponding containers, e.g., in the so-called "110 cassettes." The containers are opened in a darkroom, the films are removed from the opened containers, the removed films are transported to a trimming and splicing station where the ends of successive films are trimmed and united by adhesive-coated bands, and the resulting web is convoluted onto a reel preparatory to transport through the developing machine. The opening of containers by hand or by means of a manually operated device is a tedious and time-consuming procedure, especially since the opening of containers must take place in a darkroom. This often results in damage to exposed films due to carelessness or ineptness of the attendants. It was therefore proposed to employ an automatic opening device which cracks successive containers in a darkroom and removes the exposed films in a position in which the films are ready for transport to the trimming and splicing station. The just mentioned automatic opening device also exhibits several drawbacks, i.e., it is rather complex because each of a series of successively admitted containers must or should be cracked open at the same locus, and the device must comprise means which invariably reaches the exposed film in the opened container and transports the film in a predictable and reproducible way. As a rule, the cracking of containers (which normally consist of synthetic plastic material) is accompanied by chipping of the material of the containers whereby the fragments (some of which are rather large and many of which have sharp edges) are likely to damage or affect the operation of sensitive parts in the darkroom. Moreover, such fragments are likely to scratch or otherwise deface the exposed films.

The commonly owned U.S. Pat. No. 3,921,878 granted Nov. 25, 1975 to Zangenfeind discloses an apparatus which can remove exposed films without necessitating any opening or breaking of the containers. The film is withdrawn by the customary backing strip whose leader is expelled by a pusher which enters the container by way of a window in the back of the exposure opening and pushes the leader of the backing strip through the exposure opening. The patented apparatus can be used with advantage for removal of exposed films from "110 cassettes". In most instances, containers of the just described type are received by the processing laboratory in a condition which enables the patented apparatus to remove the exposed films without opening the respective containers. However, it happens from time to time that the exposed film, as well as the backing strip, is fully convoluted onto the takeup spool in the interior of the container. This renders it impossible to remove the exposed film without opening the container. Such situation will arise when the camera in which the film was exposed is not provided with an overload clutch which becomes effective when the user wishes to advance the film subsequent to completion of exposure of the last film frame in the container. The trailing end of the backing strip is then detached from the supply spool and is advanced beyond the aforementioned window so that the pusher is unable to expel the backing strip through the exposure opening. It has been found that between 10 to 20 percent of all containers which are delivered or shipped to a processing laboratory are not in a condition to allow for removal of exposed film without breaking the container. In other words, even if the processing laboratory is equipped with an apparatus of the type disclosed in the aforementioned patent to Zangenfeind, it is still necessary to forcibly open a relatively large number of containers in order to gain access to the exposed photographic roll films therein.

SUMMARY OF THE INVENTION

An object of the invention is to provide a novel and improved apparatus which is sufficiently versatile to receive and process films which are confined in containers as well as to receive films subsequent to removal of such films from the respective containers.

Another object of the invention is to provide an apparatus which can automatically remove exposed photographic roll films from their containers and assemble the removed films into a continuous web, together with films which must be removed from their containers prior to introduction into the apparatus.

A further object of the invention is to provide the apparatus with novel and improved means for transporting films which are introduced into the apparatus subsequent to removal from the respective containers and for transporting films which are removed from their containers in the interior of the apparatus.

An additional object of the invention is to provide the apparatus with means which prevents accidental admission of containers at a time when the apparatus is set to receive discrete films and vice versa.

An ancillary object of the invention is to provide the apparatus with novel and improved means for preventing damage to exposed films which are introduced into the apparatus subsequent to removal from the respective containers.

Another object of the invention is to provide an apparatus of the above outlined character which can be installed in existing photographic processing laboratories.

A further object of the invention is to provide an apparatus which can be manipulated by semiskilled or even unskilled persons, which can process a large number of containers and/or discrete exposed films per unit of time, and which can process exposed films without damaging the photosensitive emulsion, either by exposure to stray light or by scratching or other mechanical action.

The invention is embodied in an apparatus for processing photographic films and containers for such films. The apparatus comprises essentially a substantially lightproof housing or casing having wall means provided with first and second inlets for admission of successive loaded containers and discrete films, respectively, film removing means installed in the housing, a chute or analogous means for conveying loaded containers from the first inlet into the range of the film removing means, film splicing means in the housing, means for transporting removed films from the removing means to the splicing means, and means for transporting discrete photographic films from the second inlet to the splicing means.

The first mentioned transporting means may comprise a first guide channel which receives successive removed films from the film removing means and a second guide channel which receives removed films from the first channel and guides the films for movement toward the splicing means. The last mentioned transporting means then preferably comprises a third channel which receives discrete films from the second inlet and guides such films into the second channel for transport toward the splicing device. Thus, the two transporting means may comprise a common component (second channel) wherein removed films or discrete films advance toward the splicing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a fragmentary sectional view as seen in the direction of arrows from the line II—II of FIG. 1.

DESCRIPTION OF THE PREFERRED EMBODIMENTS

Figure 1:
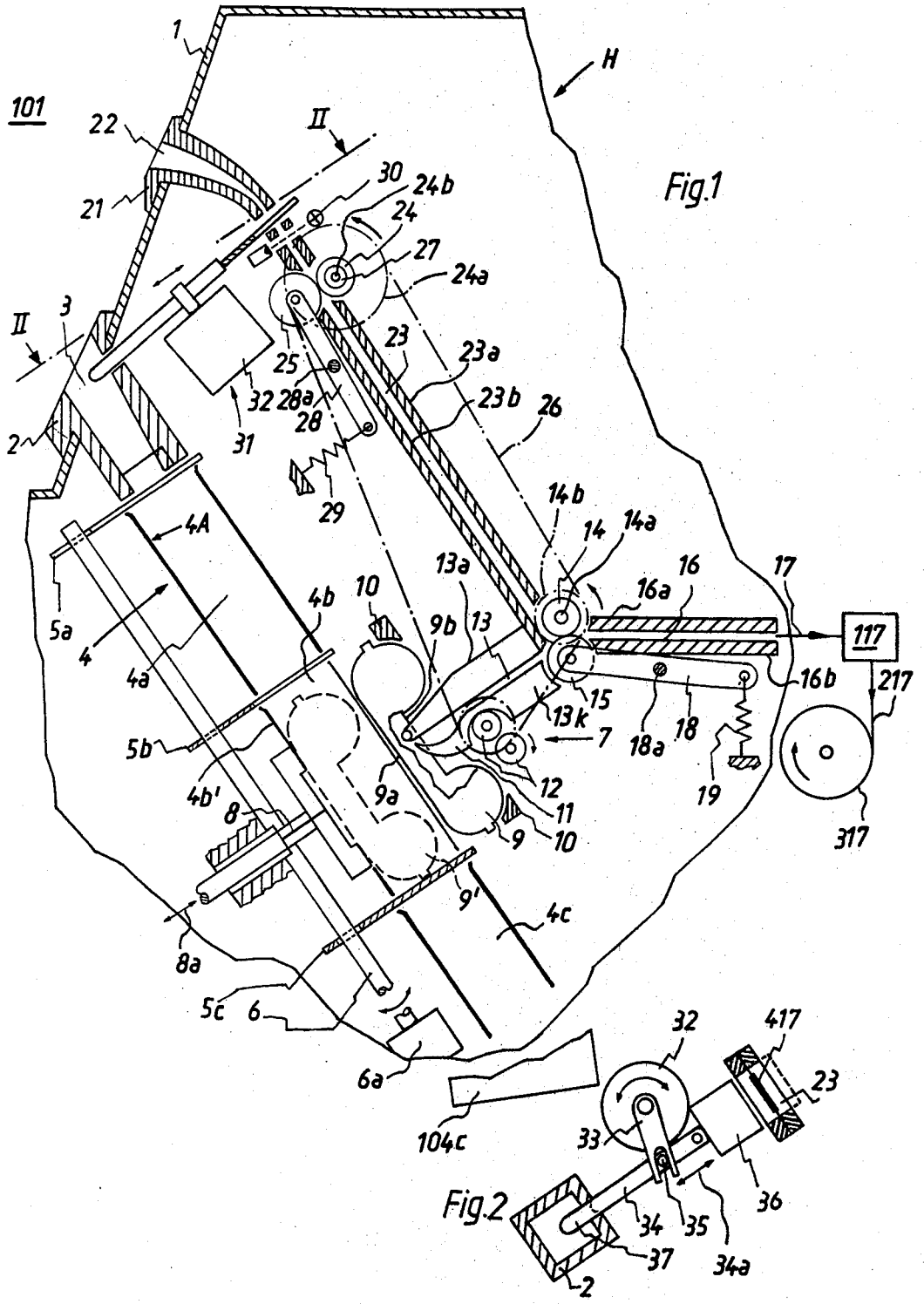
FIG. 1 is a fragmentary vertical sectional view of an apparatus which embodies the invention, the parts of the apparatus being shown in positions they assume when the apparatus is ready to receive and process discrete exposed photographic roll films.

Referring to FIG. 1, there is shown a lightproof housing H which includes a suitably inclined front wall 1 provided with two inlets 3 and 22. The inlet 3 is actually the inlet of a duct 2 of the type disclosed in commonly owned U.S. Pat. No. 3,866,744 to Klose granted Feb. 18, 1975. The duct 2 has means (such as ribs, grooves, recesses, lobes, etc.) which insures that a loaded container 9 can be introduced into the inlet 3 and that such container can advance through and beyond the duct 2 only if it is oriented in a predetermined manner such as is best suited for convenient manipulation of the container in the interior of the housing H. The inclination of the passage in the duct 2 is sufficient to insure that a properly oriented container 9 can slide therethrough by gravity and to reach a conveyor 4 here shown as a downwardly inclined chute having an antechamber 4*a* immediately downstream of the duct 2, a second chamber 4*b* immediately downstream of the antechamber 4*a*, and a third chamber 4*c* immediately downstream of the chamber 4*b*. The antechamber 4*a* can be sealed from the duct 2 by a first gate 5*a* which is turnable back and forth by an elongated shaft 6 driven by a rotary electromagnetic 6*a* or the like. The shaft 6 further carries a second gate 5*b* which is movable into and from the narrow clearance between the antechamber 4*a* and the second chamber 4*b*, and a third gate 5*c* which is movable into and from the narrow space between the chambers 4*b* and 4*c*. The inclination of the chute 4 is preferably identical or similar to the inclination of the duct 2. The manner in which the gates 5*a*–5*c* are angularly offset with respect to each other and the manner in which the gates 5*a*–5*c* are movable between operative and inoperative positions is disclosed and claimed in the commonly owned copending patent application Ser. No. 729,773 now Pat. No. 4,076,135 filed Oct. 5, 1976 by Klaus Klose for "Apparatus for processing cassettes containing exposed photographic films." The gates 5*a* and 5*c* are held in inoperative positions when the gate 5*b* is held in the inoperative position, and vice versa. The gate 5*b* supports a container 9 which descends by gravity into the antechamber 4*a* when the gate 5*a* is held in the inoperative position, and the gate 5*c* supports a container 9 in the chamber 4*b* when the gate 5*b* is held in the inoperative position. The extent of overlap of the gates 5*a* and 5*b* is such that the gate 5*b* begins to expose the outlet opening at the lower end of the antechamber 4*a* only when the gate 5*a* already seals the inlet opening at the upper end of the antechamber 4*a*, and vice versa. When the gate 5*c* is moved to the inoperative position, an empty container 9 can descend through the chamber 4*c* and into a collecting receptacle 104*c* therebelow.

The housing H further contains a film removing mechanism 7 which may be similar to that disclosed in commonly owned U.S. Pat. No. 3,921,878 granted Nov. 25, 1975 to Zangenfeind or in the commonly owned copending application Ser. No. 652,107 filed Jan. 6, 1976 by Zangenfeind for "Apparatus for removing exposed films and backing strips from containers." That side of the chamber 4*b* which faces the film removing mechanism 7 is open and the housing H contains a reciprocable transfer member 8 which can be moved in the directions indicated by a double-headed arrow 8*a* through suitable opening or openings in the adjacent portion 4*b*′ of the chute 4. When the transfer member 8 is caused to perform a forward stroke (in a direction to the right, as viewed in FIG. 1), it moves a container 9 from the gate 5*c* against suitable locating elements 10 which are adjacent the film removing mechanism 7 so that the container is in an optimum position for removal of exposed roll film from its interior. Upon removal of the film, the container 9 is returned onto the gate 5*c* which is thereupon moved to the inoperative position so that the empty container descends by gravity by moving through the chamber 4*c* and into the receptacle 104*c*.

The film removing mechanism 7 comprises a tongue-like deflector 11 which separates the leader of the backing strip from the leader of the film 17 and directs the leader of the backing strip into the nip of two advancing rolls 12 which draw the backing strip off the takeup spool in the interior of the container 9 abutting the locating means 10. The fully withdrawn backing strip descends into a separate collecting receptacle, not shown. The leader of the film 17 advances above the tip of the deflector 11 and into a first guide channel 13 which is defined by the elements 13*a*, 13*b* of a first transporting unit serving to advance successive films 17 to a splicing device 117. The first transporting unit further comprises two elements 16*a*, 16*b* which define a second guide channel 16 whose intake end is adjacent to the discharge end of the first channel 13 and wherein successive films 17 advance toward and into the splicing device 117. The latter trims the trailing end of each preceding film 17 and the leader of the next-following film 17 and connects the thus trimmed films to each other by means of one or more adhesive-coated uniting bands in a manner not forming part of the invention. The resulting elongated web 217 is collected by a spool or reel 317 and is ready for transport through a developing machine, not shown.

The film removing unit 7 further comprises a pusher (not shown) which corresponds to the pusher 5 in the apparatus of U.S. Pat. No. 3,921,878 to Zangenfeind. The pusher enters the aforementioned window in the rear panel 9*a* of a loaded container 9 which abuts against the locating means 10 and expels the leader of the backing strip through the exposure opening in the front panel 9*b* of such container. The leader of the backing strip is caused to enter the nip of the advancing rolls 12 which move the backing strip lengthwise, and the moving backing strip withdraws the leader of the exposed roll film 17. The leader of the film 17 is deflected by the tip of the deflector 11 to enter the first guide channel 13 and to advance toward and into the nip of two rotary members 14, 15 forming part of the aforementioned first transporting unit, i.e., of that unit which transports successive roll films 17 from the removing mechanism 7 to the splicing device 117. The rotary members 14, 15 are friction wheels the first of which is rotatable on a fixedly mounted shaft 14*a* and is driven by a prime mover 14*b*, e.g., an electric motor. The discharge end of the guide channel 13 is positioned in such a way that the leader of a film 17 which advances through the channel 13 invariably finds its way into the nip of the friction wheels 14, 15 and is caused to enter the second channel 16 to move toward the splicing device 117. The friction wheel 15 is mounted on one arm of a two-armed lever 18 which is fulcrumed in the housing H, as at 18*a*, and is biased clockwise by a helical spring 19 so that it bears against the friction wheel 15 in the absence of a film 17 between the wheels 14 and 15. The bias of the spring 19 (the lower end of which is anchored in the housing H) is sufficient to insure that the friction wheels 14, 15 invariably entrain the film 17 as soon as the leader of the film advances beyond the first guide channel 13, i.e., as soon as such film enters the nip of the friction wheels 14, 15. The peripheral speed of the friction wheels 14, 15 is preferably identical with that of the advancing rolls 12 for the backing strip. This insures that the film 17 travels lengthwise at the same speed before and after its leader reaches the nip of the friction wheels 14, 15. Prior to engagement of a film 17 by the friction wheels 14, 15, the film is pulled from the respective container 9 by the moving backing strip; once the wheels 14, 15 engage the film, the latter moves lengthwise into and through the channel 16 because the spring 19 biases the idler friction wheel 15 toward the periphery of the driven friction wheel 14.

The inlet 22 is defined by a conical second duct 21 which is installed in the front wall 1 of the housing H and whose passage decreases in width in a direction from the inlet 22 toward the interior of the housing. The inlet 22 serves for admission of discrete exposed photographic roll films 417 (FIG. 2) which have been removed from the respective containers 9 prior to introduction of their leaders into the duct 21. To this end, the space 101 in front of the wall 1 is temporarily converted into a darkroom and the containers which should not be fed into the chute 4 via duct 2 are cracked open in a manner as described above. This affords access to the respective exposed roll films 417 which are thereupon introduced into the housing H, one after the other, by way of the duct 21. The width of the passage which is defined by the duct 21 in the region of the phantom-line II—II of FIG. 1 preferably only slightly exceeds the thickness of an exposed roll film 417. The inlet 22 is preferably wider so as to allow for convenient threading of the leaders of successive exposed roll films 417 into and through the duct 21.

The apparatus further comprises a second transporting unit having elements 23*a*, 23*b* which define an elongated third channel 23 sloping downwardly toward the nip of the friction wheels 14 and 15. As shown, the configuration and position of the discharge end of the guide channel 23 are such that the leader of a film 417 which advances in the channel 23 invariably finds its way into the nip of the friction wheels 14, 15 to be thereupon advanced toward the splicing device 117 in the same way as a film 17 coming from the removing mechanism 7. In other words, the guide channel 16 is common to both transporting units, and the same applies for the friction wheels 14, 15. The channel 16 and the friction wheels 14, 15 can be said to form part of the first or the second transporting unit, and the friction wheels 14, 15 are located at the junction of the first and third channels 13, 23 with the second channel 16.

The second transporting unit further comprises two additional rotary members 24, 25 here shown as friction wheels which are installed in the housing H close to the discharge end of the duct 21. The diameter of the friction wheel 24 is smaller than that of the friction wheel 25, and the latter is mounted on the upper arm of a two-armed lever 28 which is fulcrumed at 28*a* and is biased clockwise by a helical spring 29 so that it bears directly against the periphery of the friction wheel 24 when the channel 23 is empty. The smaller friction wheel 24 can receive torque from a relatively large pulley or sprocket wheel 24*a* which is mounted on the shaft 24*b* for the parts 24, 24*a* and is driven by an endless belt or chain 26 receiving motion from a second pulley on the output shaft of the motor 14*b* for the friction wheel 14. The ratio of the transmission 26, 24*a* between the motor 14*b* and the friction wheel 24 is such that the peripheral speed of the friction wheel 24 is less than that of the friction wheel 14. In other words, the leader of a film 417 which has been introduced via inlet 22 and reaches the nip of the friction wheels 24, 25 advances at a relatively low speed during lengthwise movement through the guide channel 23 and thereupon at a higher speed when it reaches the nip of the friction wheels 14, 15. The shaft 24*b* drives the friction wheel 24 through the medium of an overruning clutch 27 which becomes effective as soon as the leader of a film 417 which moves in the channel 23 reaches the nip of the friction wheels 14, 15. This enables the friction wheels 24, 25 to thereupon rotate at the peripheral speed of the friction wheels 14, 15. The just described mode of operation of the second transfer unit is preferred at this time because the leader of a film 417 is less likely to be damaged when introduced by an attendant through the inlet 22 if the peripheral speed of the friction wheels 24, 25 is relatively low.

A photoelectric cell 30 or an analogous detector is mounted adjacent the upper end of the guide channel 23 (upstream of the nip of the friction wheels 24, 25) to monitor the channel 23 for the presence or absence of an exposed film 417 therein. When the cell 30 detects the leader of a film 417 (which has been introduced via inlet 22 of the duct 21), the transducer of the cell 30 transmits a signal which starts the motor **14*b* for the friction wheels 14 and 24. The diameter of the friction wheel 24 may but need not be smaller than the diameter of the friction wheels 14, as long as the transmission 26, 24*a* insures that the peripheral speed of the friction wheel 24 (while the latter is positively driven by the sprocket wheel or pulley 24*a*) is less than the peripheral speed of the friction wheels 14, 15**.

The apparatus of FIG. 1 still further comprises a device 31 for selectively blocking the inlets 3 and 22. The details of the blocking device 31 are shown in FIG. 2. A reciprocable blocking slide 34 is movable in the housing H back and forth in directions indicated by a double-headed arrow **34*a*. The median portion of the slide 34 has a follower pin 35 which is received in the forked portion of an armature 33 forming part of a rotary electromagnet 32. When the armature 33 is turned clockwise, as viewed in FIG. 2, the left-hand end portion 37 of the slide 34 enters the duct 2 and extends into the interior of the inlet 3 to such an extent that the attendant is unable to introduce a container 9. At the same time, the slide 34 withdraws its vane-like or plate-like right-hand end portion 36 from the guide channel 23 or from an opening in the lowermost part of the passage which is defined by the duct 21. If the electromagnet 32 rotates the armature 33 in a counterclockwise direction, as viewed in FIG. 2, the end portions 37, 36 assume the positions which are indicated by broken lines, i.e., the end portion 37 permits the admission of containers 9 via inlet 3 of the duct 2 and the end portion 36 prevents the admission of exposed films 417 via inlet 22 of the duct 21. The end portion 37 may constitute a stud with a rounded end. The means for energizing the electromagnet 32 is preferably actuatable by one or more knobs or the like on the control panel of the apparatus. Such energizing means includes conventional devices for connecting the electromagnet 32 in circuit with an energy source in such a way that the armature 33 rotates clockwise or anticlockwise, as viewed in FIG. 2**.

The operation:

Since the number of containers 9 wherein the backing strips are in proper position for expulsion of their leaders by the pusher of the film removing mechanism 7 normally greatly exceeds the number of containers which must be cracked open in order to allow for removal of exposed films 417 from their interior, the control knob or knobs for energization of the electromagnet 32 are normally set in such a way that the slide 34 assume the broken-line position of FIG. 2 in which the end portion 37 is withdrawn from the inlet 3 of the duct 2 and the end portion 36 extends across the path for films 417 which are to be introduced via inlet 22 of the duct 21. The end portion 36 of th slide 34 preferably seals the channel 23 (or at least the lower portion of this channel) against the penetration of any light which enters the passage of the duct 21 by way of the inlet 22. The space 101 can be illuminated by daylight or by artificial light so that the attendant or attendants need not work in a darkroom during introduction of containers 9 into the duct 2. Successive containers 9 are fed into the chute 4 in a predetermined orientation so that their rear panels **9*a* slide along the surface 4A of the chute and come to rest on the gate 5*b* which then assumes its operative position (the gates 5*a* and 5*c* are held in their inoperative positions whenever a container 9 is introduced into the inlet 3 of the duct 2). The antechamber 4*a* of the duct 4 may contain a detector (e.g., a photoelectric cell shown in the aforementioned copending application Ser. No. 729,773 of Klose) which energizes the electromagnetic 6*a* when a container 9 comes to rest on the gate 5*b*. This causes the shaft 9 to move the gates 5*a*, 5*c* to operative positions and to move the gate 5*b* to the inoperative position so that the container 9 leaves the antechamber 4*a* by gravity and comes to rest on the gate 5*c*, i.e., such container is then received in the second chamber 4*b* of the chute 4. The container 9 on the gate 5*c* is detected by a further detector, not shown, which causes the transfer member 8 to perform a forward stroke and to move the container from the broken-line position 9' to the solid-line position of FIG. 1 in which the container is held by the prongs of the transfer member 8 and by the locating elements 10. The aforementioned pusher then performs a working stroke and expels the leader of the backing strip from the container 9 so that the leader of the backing strip is engaged and entrained by the advancing rolls 12. The tip of the deflector 11 intercepts the oncoming leader of the exposed film 17 and directs the leader of the film into the channel 13 where the leader advances toward and into the nip of the friction wheels 14, 15 which rotate because the motor 14*b* is on. The leader of such film 17 then advances in the channel 16 and is spliced to the trailing end of the preceding film as soon as it reaches the splicing device 117. The spool 317 is rotated at necessary intervals to collect the resulting web 217 which may be several hundred meters long before the spool 317 is transferred into the developing machine. The rolls 12 complete the withdrawal of backing strip from the container 9 which abuts against the locating elements 10 before the transfer member 8 returns the empty container onto the gate 5*c* which is thereupon moved to inoperative position so that the empty container descends into and beyond the third chamber 4*c* and is intercepted by the receptacle 104*c*. The return stroke of the transfer member 8 can be monitored by a further detector which causes the electromagnet 6*a* to rotate the shaft 6 to the other end position in which the gate 5*b* seals the lower end of the antechamber 4*a* and the gates 5*a*, 5*c* assume their inoperative positions so that an attendant can admit the next-following container 9 into the antechamber 4*a*. The same procedure is repeated again and again until the supply of containers 9** with properly positioned leaders of backing strips therein is exhausted.

As a rule, the attendant or attendants will inspect each container 9 which is to be introduced into the duct 2. If the attendants note that the leader of the backing strip is not located behind the aforementioned window in the rear panel **9*a* of a container, such container is put aside because it is not suited for removal of film from its interior by means of the film removing mechanism 7. When the last container 9 with a properly positioned backing strip therein has been introduced into the antechamber 4*a* and after the mechanism 7 has completed the removal of exposed film 17 from such container (the removal is normally completed within a few seconds), an attendant actuates the aforementioned knob or knobs on the control panel to move the blocking slide 34 to the position shown in FIG. 1 (such position corresponds to the broken-line position of the slide 34 in FIG. 2). Thus, the inlet 3 cannot admit containers into the chute 4. The space 101 is then converted into a darkroom and the attendant or attendants operate the aforementioned opening device which cracks the casings of containers with improperly positioned (fully convoluted) backing strips therein so as to gain access to the exposed films 417 in the interior of such containers. Successive films 417 are thereupon introduced into the inlet 22 of the duct 21 so that their leaders advance across the path of light between the light source and the transducer of the photoelectric cell 30. The transducer starts the motor 14*b* (this motor is preferably arrested in response to or simultaneously with movement of the blocking slide 34 to the position shown in FIG. 1) which causes the friction wheels 24, 25 to entrain the films 417, one after the other, into the channel 23 and thereupon into the nip of the friction wheels 14, 15. These friction wheels advance the films 417, at a speed higher than that imparted by the friction wheels 24, 25, through the channel 16 and to the splicing device 117 which unites successive films 417 end-to-end to form a web which may constitute a continuation of the web 317 including films 17 which have been removed by the mechanism 7. As mentioned above, the lower peripheral speed of friction wheels 24, 25 is desirable at this time because the films 417 are less likely to be broken or otherwise damaged during and immediately after introduction of their leaders into the uppermost portion of the channel 23. Once the leader of a film 417 reaches the nip of the friction wheels 14, 15, the film can be transported at a much higher speed because the attendant need not assist in the running of a film 417 during entry of its rear portion into the duct 21 and thence into the channel 23. The overrunning clutch 27 insures that the friction wheels 24, 25 can rotate at a higher peripheral speed as soon as the leader of the respective film 417 reaches the friction wheels 14, 15. In other words, a film 417 is advanced by the wheels 24, 25 (which are then positively driven by the pulley or sprocket wheel 24*a*) while the leader of such film is located upstream of the friction wheels 14, 15, and the film 417 is thereupon positively advanced by the friction wheels 14, 15; at the same time, the film 417 drives the friction wheels 24, 25 at the higher peripheral speed because the clutch 27 allows the wheel 24 to rotate relative to the sprocket wheel or pulley 24*a* as soon as the peripheral speed of the wheel 24** exceeds a predetermined value.

Each web 217 which is convoluted on the spool 317 may be provided with an elongated flexible tape which is attached to the leader of the first or foremost film and/or to the trailing end of the last or rearmost film. Such tapes are often desirable and advantageous in order to allow for convenient threading of the leader of the web 217 through a developing machine and/or the splicing to the leader of the next-following web. For example, if the tape is to be spliced to the last film of a web 217 on the reel 317, the leader of such tape is introduced into the channel 23 in the same way as the leader of a film 417. The tape advances through the channels 23, 16 and its leader is spliced to the trailing end of the last film forming a web 217 on the reel 317. When the reel 317 is transferred into a developing machine, the tape constitutes an elongated leader of the respective web 217 and is threaded through the developing machine which is started only when the foremost film of the web reaches the first liquid-containing tank. A tape which has been spliced to the foremost or innermost film on the reel 317 can be used for splicing of the last film of the respective web 217 to the foremost film of the next-following web.

An important advantage of the improved apparatus is that the majority of containers 9 can be manipulated by attendants in daylight or other light, i.e., not in a darkroom. Furthermore, the apparatus is sufficiently versatile to be capable of splicing together films (17) which are removed from containers 9 in the interior of the housing H as well as films (417) which must be removed from containers prior to introduction into the housing. Still further, the apparatus comprises a relatively small number of components; this is attributable in part to the fact that certain elements of the transporting unit for films 17 which are removed by the mechanism 7 are common to the transporting unit which advances films 417 from the duct 21 into the range of friction wheels 14, 15 at the junction of the channels 13, 23 with the preferably horizontal second channel 16. Since the number of containers with improperly positioned backing strips therein normally constitutes only between 10 and 20 percent of the total number of containers, the space 101 is preferably converted into a darkroom upon completed processing of all containers 9 which can be relieved of films 17 by the removing mechanism 7. The period of time during which the space 101 must constitute a darkroom is relatively short, i.e., it suffices to convert the space 101 into a darkroom only once during an entire shift.

A further important advantage of the improved apparatus is that the aforementioned tape can be introduced into the housing H by way of the duct 21 while the space 101 is illuminated by daylight or by artificial light other than that needed in a darkroom. For example, when the roll of web 217 on the reel 317 is large enough to warrant its transfer into the developing machine, the blocking slide 34 can be moved to the solid-line position of FIG. 1 while the space 101 remains illuminated by daylight, and a tape is fed into the duct 21 so as to be spliced to the last or outermost film of the web 217. Such procedure can be followed regardless of whether the web 217 on the reel 317 consists of films 17 which were conveyed through the channels 13, 16 or of films 417 which were conveyed through the channels 23, 16.

A device which can be used for opening of containers 9 by cracking their casings is disclosed, for example, in commonly owned U.S. Pat. No. 3,715,261 granted Feb. 6, 1973, to Hennig et al.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In an apparatus for processing photographic films and containers for such films, a combination comprising a substantially lightproof housing having wall means provided with first and second inlets for admission of successive loaded containers and discrete films, respectively; film removing means in said housing; means for conveying containers from said first inlet into the range of said removing means; film splicing means in said housing; means for transporting films from said removing means said splicing means, including a first guide channel which receives successive films from said removing means and a second guide channel which receives successive films from said first channel and directs such films toward said splicing means; and means for transporting films from said second inlet to said splicing means, including a third channel wherein films advance from said second inlet into said second channel.

2. A combination as defined in claim 1, further comprising means for selectively blocking said inlets.

3. A combination as defined in claim 2, wherein said blocking means comprises a device which blocks said first inlet against admission of containers while said second inlet is free to receive films and vice versa.

4. A combination as defined in claim 2, wherein said blocking means comprises a blocking member which is movable between first and second positions in which said member respectively prevents the admission of containers by way of said first inlet and the admission of films by way of said second inlet.

5. A combination as defined in claim 4, wherein said blocking member is reciprocable between said first and second positions and further comprising rotary electromagnet means arranged to move said member between such positions.

6. A combination as defined in claim 5, wherein said electromagnet means comprises a pivotable armature and further comprising a pin-and-slot connection between said blocking member and said armature, said blocking member having a substantially stud-shaped first portion which extends into said first inlet in said first position of said member and a substantially plate-like portion which extends across said second inlet in the second position of said member.

7. A combination as defined in claim 1, wherein said conveying means comprises a chute.

8. A combination as defined in claim 7, wherein said conveying means further comprises means for transferring successive loaded containers from said chute into the range of said removing means and for transferring empty containers from such range back into said chute.

9. In an apparatus for processing photographic films and containers for such films, a combination comprising a substantially lightproof housing having wall means provided with first and second inlets for admission of successive loaded containers and discrete films, respectively; film removing means in said housing; means for conveying containers from said first inlet into the range of said removing means; film splicing means in said housing; means for transporting films from said removing means to said splicing means, including a first guide channel which receives successive films from said removing means and a second guide channel which receives successive films from said first channel and directs such films toward said splicing means; and means for transporting films from said second inlet to said splicing means, including a third guide channel wherein films advance from said second inlet into said second channel, one of said transporting means further including a pair of rotary members located at the junction of said first and third channels with said second channel, said rotary members having a nip which receives films from either of said first and third channels.

10. A combination as defined in claim 9, wherein said rotary members are friction wheels.

11. A combination as defined in claim 9, further comprising means for driving at least one of said rotary members.

12. A combination as defined in claim 9, wherein said last mentioned transporting means comprises a pair of additional rotary members arranged to advance films from said second inlet, through said third channel, and into the range of said first mentioned rotary members.

13. A combination as defined in claim 12, wherein said additional rotary members are adjacent to said second inlet.

14. A combination as defined in claim 12, further comprising means for driving at least one of said additional rotary members.

15. A combination as defined in claim 14, further comprising means for actuating said driving means in response to introduction of a film into said second inlet.

16. A combination as defined in claim 15, wherein said actuating means comprises a detector in said housing adjacent to the path of movement of films from said second inlet to said additional rotary members.

17. A combination as defined in claim 14, further comprising means for driving at least one of said first mentioned rotary members at a peripheral speed exceeding the peripheral speed of said additional rotary members.

18. A combination as defined in claim 17, wherein said first mentioned driving means receives torque from said last mentioned driving means.

19. A combination as defined in claim 18, wherein said rotary members are friction wheels and the diameter of said one additional rotary member is less than the diameter of said one first mentioned rotary member.

20. A combination as defined in claim 17, further comprising overrunning clutch means interposed between said first mentioned driving means and said one additional rotary member to allow said additional rotary members to rotate at a higher peripheral speed when the leader of a film which has been admitted by way of said second inlet reaches and is advanced by said first mentioned rotary members.

* * * * *